US006837295B2

(12) United States Patent
Wang

(10) Patent No.: US 6,837,295 B2
(45) Date of Patent: Jan. 4, 2005

(54) MAGNETIC TRANSMISSION FOR AN ADJUSTABLE CURTAIN DISPOSED IN A DOUBLE PANE WINDOW

(76) Inventor: Zhongming Wang, Building 7, 2nd Floor, Nong Ken Bureau, 135# Qi Xing Road, Nan Ning City, Guangxi, P.R. (CN), 530022

( * ) Notice: Subject to any disclaimer, the term of this patent is extended or adjusted under 35 U.S.C. 154(b) by 0 days.

(21) Appl. No.: 10/312,026

(22) PCT Filed: Jun. 8, 2001

(86) PCT No.: PCT/CN01/00923

§ 371 (c)(1),
(2), (4) Date: Dec. 19, 2002

(87) PCT Pub. No.: WO02/01034

PCT Pub. Date: Jan. 3, 2002

(65) Prior Publication Data

US 2003/0089462 A1 May 15, 2003

(30) Foreign Application Priority Data

Jun. 22, 2000 (CN) ..... 00118442 A

(51) Int. Cl.[7] ..... E06B 9/264
(52) U.S. Cl. ..... 160/107; 160/168.1 P
(58) Field of Search ..... 160/107, 168.1 P, 160/176.1 P, 310, 311, 177 R, 98, 188

(56) References Cited

U.S. PATENT DOCUMENTS 4,817,698 A * 4/1989 Rossini et al. ..... 160/107
5,178,200 A * 1/1993 Hagen ..... 160/107
5,396,944 A 3/1995 Rossini
5,699,845 A * 12/1997 Jelic ..... 160/107
5,769,142 A * 6/1998 Nicolosi ..... 160/107
6,059,006 A * 5/2000 Rossini ..... 160/107
6,095,223 A * 8/2000 Rossini et al. ..... 160/107
6,332,491 B1 * 12/2001 Rossini ..... 160/107
6,401,790 B1 * 6/2002 Dai et al. ..... 160/107

FOREIGN PATENT DOCUMENTS

| | | |
|---|---|---|
| CN | 95250277 | 12/1995 |
| CN | 95229065.0 | 12/1995 |
| CN | 97211572.2 | 2/1997 |
| CN | 98210257.7 | 1/1998 |
| CN | 99107085.2 | 5/1999 |
| CN | 99215923.7 | 7/1999 |

* cited by examiner

*Primary Examiner*—David Purol
(74) *Attorney, Agent, or Firm*—Thorpe North & Western, LLP

(57) ABSTRACT

A magnetic transmission system for an adjustable curtain installed inside a double pane window. Under full insulation condition of the double pane window, by use of two magnetic pieces separated by the glass, the rotation of the magnetic pieces will drive a pull cord, which will then effectively control and adjust the status of the curtain which is installed inside the window. The invention provides large transmission power in a small space. In addition to the typical thermal and acoustic insulation functions, the invention adds additional function of easy and flexible light adjustment. The invention can be widely used in different applications, such as standard home doors and windows, movable windows and large-scale windows, door and glass walls, skylights, etc.

4 Claims, 1 Drawing Sheet

MAGNETIC TRANSMISSION FOR AN ADJUSTABLE CURTAIN DISPOSED IN A DOUBLE PANE WINDOW

Figure 1:
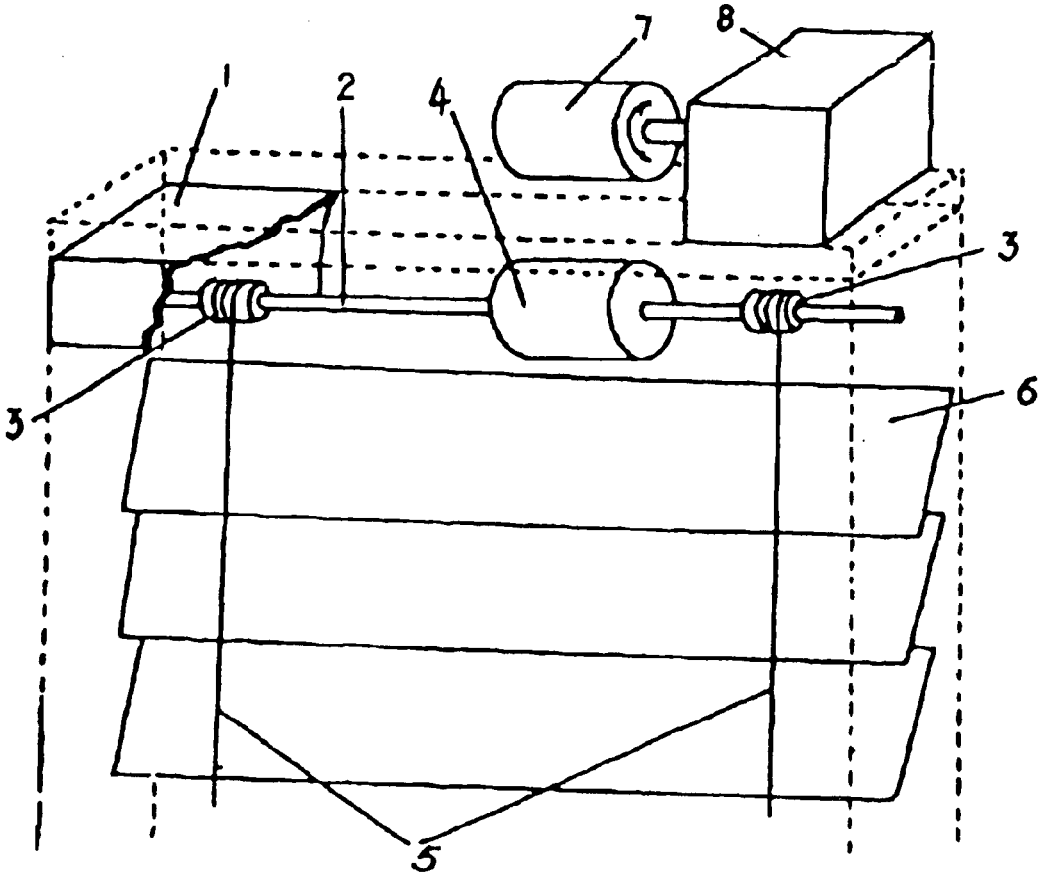

This application claims priority from International Application no. PCT/CN01/00923 filed on Jun. 8, 2001 under the provisions of the Patent Cooperation Treaty.

TECHNOLOGICAL FIELD OF THE INVENTION

This invention relates to a magnetic transmission system for adjustable curtains or blinds installed between the panes of a sealed double pane window.

EXISTING TECHNOLOGY PRIOR TO THE INVENTION

After over 100-years of development, double pane windows are now widely used, thanks to their unique benefits, such as insulation for heat, sound and temperature, safety and comfort, anti-frost and dust-proof configuration, and environmental protection and energy saving benefits, etc. The German government, for example, stipulates by legislation that in all buildings double pane windows must be used and single pane windows are forbidden. In North America, as much as 95% of windows use double pane glass. According to incomplete statistics, use of double pane windows in China has reached over 5 million square meters annually. As living standards continue to improve in China, there will be a continued increase in popularity of double pane windows in China.

Multi-layer glass is mainly used for door and window panes. In order to block light and for the sake of privacy, the door and/or window is ordinarily matched with one of various kinds of window curtains. However, typical window curtains hang outside the glass, and thus easily become dirty and worn-out, and can be troublesome to wash and clean.

Because there exists a gap between the window panes, it is possible to install a curtain inside the window. Under this concept, the curtain installed inside the double pane window advantageously is not only useful for light adjustment, but the configuration also helps preserve the cleanness of the curtain itself. For this reason, there recently has been rapid development and promotion of use of double pane windows with adjustable curtains installed inside. For example, a large quantity of double pane windows having internal blinds have been placed on the commercial market from Denmark (Nordicon Co.) and Canada (Unicel Co.), and are widely used in various kinds of doors, windows, glass walls, skylights, etc.

However, because these prior structures use direct mechanical transmissions to manipulate the internal blinds, almost all of them have a sealing problem with respect to the glass panes. Though a solution to the problem has been developed, the promotion and application of the related technology has been limited because the solution is complicated and expensive.

In China, China Patent No. 95229065, for An Integrated Door/Window by Double-layer Glass with Horizontal Shutter Installed Inside has difficulty maintaining a full insulating condition of the double-layer glass. As for some other devices—China Patent No. 9721572, for a Magnetically-Driven Layer-Added Adjustable Screen, China Patent No. 98210257, for a Fully Insulated Shutter, and U.S. Pat. No. 5,396,944, for a Device For Operating A Venetian Blind Or The Like Placed Inside An Insulating Glass Frame—though these all use a magnetic transmission to solve the sealing and insulation problem of multi-layer windows, they use structures composed of two magnetic pieces sliding but separated by the glass to achieve motion transmission, and the transmitted power is limited but with larger movement area needed. Hence, this produces some inconvenience in actual use of these devices.

PURPOSE OF THE INVENTION

The purpose of the invention is to provide a magnetic transmission system for an adjustable blind installed between panes of a multiple-pane window. The device is able to provide motion transmission via a pull cord, to make the curtain installed inside the window adjustable under full insulation condition, by use of two magnetic pieces with a rotating movement that are separated by the glass. The transmission power of such a device is large while the working area needed is small. The device can effectively control and adjust various kinds of curtains or blinds installed inside the window via a pull cord.

TECHNOLOGICAL SCHEME OF THE INVENTION

The invention achieves its purpose in the following ways. Any of various kinds of adjustable curtains or blinds may be installed inside the multi-layer window as desired. One end of the pull cord is connected with the top or bottom of the curtain, and another end of the cord is wound on a wind wheel assembled with a magnetic piece. At the corresponding position outside the glass exists another similar magnetic piece. With force applied from the outside, these magnetic pieces can rotate within a specified area. Through magnetic force, the magnetic piece inside the window will have the same movement, which will actuate the pull cord, so the curtain inside the sealed glass can be controlled and adjusted.

The magnetic transmission system for an adjustable curtain installed inside double pane windows provided by the invention is suitable for different adjustable curtain structures in different situations and with different requirements inside the double pane window.

FIGURE DESCRIPTION

The basic operating mode of the invention will be further described with respect to the attached FIGURE:

FIG. 1 is a schematic drawing showing the operation of part of a magnetic transmission system that controls and adjusts a curtain installed inside a double pane window.

EMBODIED EXAMPLE

The adjustable blinds installed in an insulated multi-layer window comprise a beam (1), a freely rotating long shaft (2) which is assembled inside the beam, a fixed wind wheel (3) and a first magnetic wheel (4) assembled on the long shaft, a pull cord (5), and a curtain slat group (6). One end of the pull cord is connected to the bottom slat of the curtain slat group, while the other end of the pull cord is wound on the fixed wind wheel. Outside the window glass or other structure (e.g. the window frame) and at the corresponding position, is a second magnetic wheel (7) aligned axially parallel to the first magnetic wheel, and an electric motor and variable speed device (8).

During operation, the second magnetic wheel (7) located outside the glass is driven by the variable speed device (8) through the electric motor, and rotates clockwise. Inside the window, the first magnetic wheel (4), which is axially parallel to the first magnetic wheel (7), rotates correspondingly through magnetic interaction, which in turn, makes the axial wind wheel (3) rotate, and thus winds the pull cord (5), so that the slats in the slat group (6) move up or down.

One or more sets of additional, similar magnetic transmissions and pull cord systems can be added to this structure in order to control axial rotation of the slats, or to control raising or lowering of the top slat, so that lighting can be adjusted.

When needed, two or more sets of magnetic transmissions and pull cord systems can be installed in the same window frame. These may be used to pull the top slat and bottom slat, respectively, of the curtain, so that the curtain can be opened either downwards or upwards, and can even be opened or closed at any section of the curtain.

For convenience, and if there is sufficient space inside the double pane window, two or more sets of adjustable curtains with magnetic transmissions and pull cord systems can be installed to achieve other functional adjustments. For example, one set may be used for daylight adjustment, and the other for night adjustment before going to bed.

With regard to the adjustable blinds controlled by magnetic transmission as described above, when there is a small distance between the glass panes, sliding adjustable blinds can be used. If the space between the glass panes is sufficient and the blind slats can have free rotation, the slat-rotation-type curtain (i.e. venetian blinds) can be used. Apart from the adjustable blinds, other continuously connected curtain structures can be used, such as shutter-screens, folded-screens, or rolling-type curtains, etc. Because the curtain installed inside the double pane window will not basically be affected by outside force or outside ambient conditions, it can be kept clean forever. Therefore, materials for the manufacture of such a curtain can be various light and thin materials, such as metal foils and plastic films, silk cloth and other thin and light materials. Especially when it is used for indoor purposes, the curtain can be made into various delicate pieces of art or paintings without worry of becoming dirty or ruined.

There are multiple modes to drive the magnetic piece located outside of the glass. Referring to the source of power, there are manual power and electric power. For manual power, a user can pull the pull cord by hand via the wind wheel, in connection with a soft shaft transmission, cross and coupling shaft transmission, and sector gear transmission. All these transmission systems may be installed inside the window frame without any component being exposed outside. For electric power, the driven system is simpler, whether using a direct drive or variable speed drive, to drive the magnetic piece located outside the window to make it rotate.

It is easy to design and use the system for different environmental and usage demands. For example, for various larger windows, especially the fixed-type multi-layer floor-to-ceiling windows, glass walls and skylights, etc., a direct motor-driven or variable speed drive device can be used. Because the transmission power of the invention is very large and the space needed is very small, it is easy to have remote control and automatic control combined with the invention. In particular, as all parts and components of the motor and variable speed device are installed outside the glass, it is very convenient for repair and maintenance.

Thanks to its features, an adjustable curtain employing the present invention hopefully can be widely used in different scenarios. First, because the inner space demanded by both the curtain and the magnetic transmission is quite small, it can fully meet the needs of the current standard specifications for double pane windows—the normal inner distance between panes of standard double pane windows is 6 mm–12 mm, big enough for the curtain to move upwards or downwards, and for the magnetic piece to operate. Additionally, use of the invention will not affect the production process of the double pane window at all. Secondly, the invention can be used in any type of self-made multi-layer windows (i.e. non-prefabricated windows produced from scratch on-site) or any scenarios such as large-scale assembled glass doors, glass walls, skylights, etc. What is needed is to put the installed curtain into the multi-layer window, and then to seal it well for insulation. After completion of the installation of the curtain, the magnetic transmission system together with the driving parts is then installed at a proper position outside the glass. Another feature of the invention is that the material of the inside curtain is light and thin with low manufacturing cost and simple structure, and it is not easily worn out and has a long useful life. In general, compared with other curtains of a similar type, the curtain with use of the invention is superior both in performance and in price.

A double pane window with a curtain employing the present invention is naturally a desirable combination for various usage scenarios. It not only possesses good insulation performance for heat and sound, but also is more flexible and convenient for light adjustment when rotatable adjustable blinds (i.e. venetian blinds) are used. For example, when it is installed for home use, the window itself will possess the entire window functions, without the need to affix other curtains and related accessories. And for use in public places, the double pane windows that employ the present invention will totally solve problems that occur to other types of curtains, such as easily becoming dirty, worn-out, poor looking, etc. When it is used for large-scale glass walls or skylights, it provides good light adjustment and automation performance superior to any other similar devices available now.

What is claimed is:

1. An adjustable curtain for a double pane window, comprising:

a) an adjustable curtain installed between panes of a sealed double pane window, the adjustable curtain including
   1) a group of slats;
   2) a rotatable shaft; and
   3) a pull cord, operably connected to the slat group and the rotatable shaft; and b) a magnetic transmission system configured to move the slat group to selectively block or unblock passage of light through the window, including:
   1) a first magnetic wheel, fixed on the rotatable shaft inside the sealed double pane window; and
   2) a second magnetic wheel, disposed outside the double pane window, having an axis of rotation parallel to the rotatable shaft, magnetically coupled to the first magnetic wheel, such that rotation of the second magnetic wheel causes corresponding rotation of the first magnetic wheel and the rotatable shaft, so as to wind or unwind the pull cord.

2. An adjustable curtain in accordance with claim 1, further comprising a wind wheel, fixed on the rotatable shaft, the pull cord having a first end connected to a bottom slat of the slat group, and a second end wound on the wind wheel.

3. An adjustable curtain in accordance with claim 1, wherein the curtain is comprised of materials selected from the group consisting of metal foil, plastic film, and silk cloth.

4. An adjustable curtain in accordance with claim 2, wherein the curtain is comprised of materials selected from the group consisting of metal foil, plastic film, and silk cloth.

* * * * *